US006547618B1

(12) United States Patent
James et al.

(10) Patent No.: US 6,547,618 B1
(45) Date of Patent: Apr. 15, 2003

(54) SEAL AND METHOD OF SEALING FIELD EMISSION DEVICES

(75) Inventors: Alan L. James, Phoenix, AZ (US); Kevin M. Reinhart, Chandler, AZ (US)

(73) Assignee: Motorola, Inc., Schaumburg, IL (US)

( * ) Notice: Subject to any disclaimer, the term of this patent is extended or adjusted under 35 U.S.C. 154(b) by 308 days.

(21) Appl. No.: 09/654,719

(22) Filed: Sep. 5, 2000

(51) Int. Cl.[7] ..... H01J 9/26; H01J 9/32
(52) U.S. Cl. ..... 445/25; 445/24
(58) Field of Search ..... 445/24, 25; 228/121

(56) References Cited

U.S. PATENT DOCUMENTS 4,848,643 A * 7/1989 Frische et al. ..... 228/121
5,811,927 A * 9/1998 Anderson et al. ..... 313/495
6,036,567 A 3/2000 Watkins
6,042,445 A 3/2000 Amrine et al.
6,113,450 A * 9/2000 Narayanan et al. ..... 445/25
6,129,603 A * 10/2000 Sun et al. ..... 313/495
6,152,796 A * 11/2000 Nakata ..... 313/496
6,254,449 B1 * 7/2001 Nakanishi et al. ..... 445/25

FOREIGN PATENT DOCUMENTS

WO WO 97/23893 7/1997
WO WO 99/59180 11/1999

* cited by examiner

*Primary Examiner*—Kenneth J. Ramsey
*Assistant Examiner*—German Colón
(74) *Attorney, Agent, or Firm*—William B. Koch; James A. Lamb

(57) ABSTRACT

A method of fabricating a high vacuum device by providing two major, parallel spaced apart glass sides in a substantial vacuum, forming a continuous edge between the sides and forming a tack with a metallic diffusion bond between the sides. The metallic diffusion bond is formed of materials that bond and cure faster than the material of the continuous edge so that the tack holds the sides in a fixed position while the continuous edge is curing.

14 Claims, 1 Drawing Sheet

SEAL AND METHOD OF SEALING FIELD EMISSION DEVICES

FIELD OF THE INVENTION

This invention relates to a seal and methods of sealing field emission devices and more particularly, to a high vacuum seal in devices with a flat profile.

BACKGROUND OF THE INVENTION

Flat panel displays incorporating field emission devices require good vacuum conditions for peak performance and long operating lifetimes. The method used to make the vacuum seal greatly influences the overall vacuum conditions. Because a field emission device (FED) has a larger surface area-to-volume ratio than almost any other vacuum product, the task of producing good vacuum is much more difficult than in other vacuum devices.

Many methods for manufacturing sealed vacuum envelopes, i.e., FED packages, use vitreous frit to seal the anode to the cathode. To achieve high volume manufacturing, FED packages must be moved to a curing chamber or station within a few minutes of being sealed to free up the vacuum chamber. Until the frit cures, however, it remains in a low viscous state, and any relative movement of the components of the envelope can create a misalignment that can fail the package. To avoid this problem, present methods cure sealed vacuum envelopes in the same chamber the seal is made, which impedes high production throughput.

Thus, there is a need for a sealed vacuum envelope and methods of producing the sealed vacuum envelope which greatly increases throughput and which allows the sealed vacuum envelope to be handled while the frit is in a low viscous without the risk of component misalignment.

BRIEF DESCRIPTION OF THE DRAWINGS

Referring to the drawings.

DESCRIPTION OF THE PREFERRED EMBODIMENT

Figure 1:
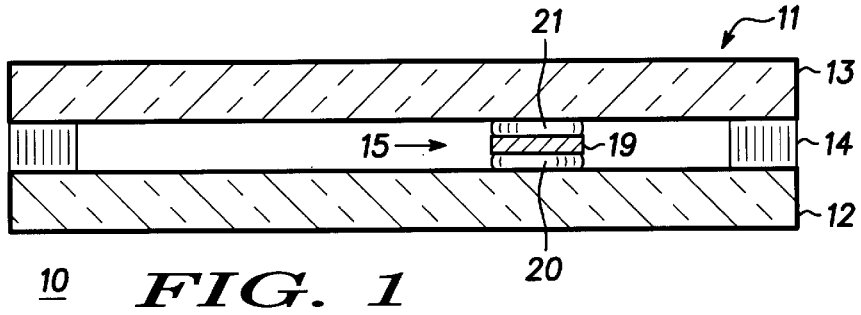
FIG. 1 is a sectional view of a vacuum envelope sealed with a continuous edge and a tack in accordance with the present invention.

Turning now to the figures, FIG. 1 illustrates a high vacuum field emission display 10 with flat form factor. Display 10 comprises an envelope 11 including two major, parallel spaced apart glass sides 12 and 13 with a continuous edge 14 therebetween and at least one tack 15 therebetween. Edge 14 provides a reasonable vacuum seal (e.g. less than approximately 2×10–13 torr liter/sec) between sides 12 and 13 and preferably comprises vitreous frit. Generally, as will be understood by those skilled in the art, an electronic device is housed within envelope 11, which requires a relatively high vacuum for it to operate properly. Display 10 includes a type of electronic device, such as a field emission device (FED) package, to produce pictures, writing, etc. Since FED packages are well known in the art, no further description of the structure or operation is believed necessary, except to state that in this example side 12 may be the cathode and side 13 may be the anode upon which the pictures, writing, etc. are formed. Sides 12 and 13 may be reversed if desired. While the term "glass" is used to describe sides 12 and 13, it will be understood by those skilled in the art that any material, such as glass, quartz, semiconductor substrates, etc. can be used for sides 12 and 13 and for edge 14 and the term glass is intended to incorporate all such materials.

Tack 15 can be located within the vacuum substantially formed by edge 14 as generally shown in FIG. 1, at edge 14 or at other locations between sides 12 and 13. Tack 15 is comprised of chip or pad 19 secured to side 12 by a bond 20 and to side 13 by a bond 21. Chip 19 is generally formed of a ceramic or other similar non-metallic material and is relatively small, preferably approximately 4×4 mm square and 0.7 mm thick, which substantially approximates the overall dimension of tack 15. Chip 19 may be provided in other approximately similar sizes, and may be constructed of any shape consistent with this disclosure. Because tack 15 is so small, it may be positioned at any location between sides 12 and 13, including at edge 14, without interfering the operation of display 10. Although FIG. 1 shows only one tack 15, display 10 may incorporate two or more.

Figure 2:
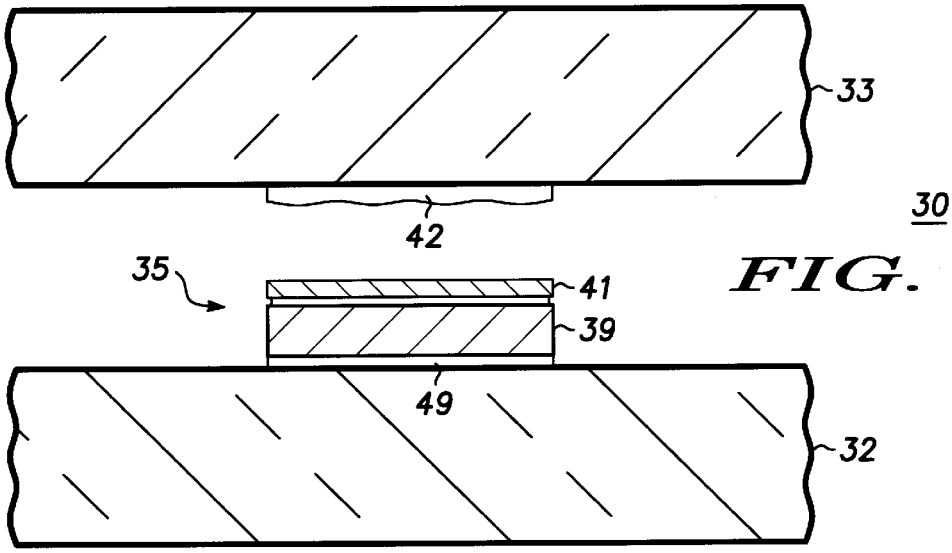
FIG. 2 is a sectional view of a portion of the envelope of FIG. 1 showing an embodiment of the tack as it would appear prior to being sealed.

Prior to being sealed together, sides 12 and 13 comprise separate parts that are manufactured as discrete components. Referring to FIG. 2, an embodiment of a tack 35 is illustrated prior to the sealing of a display 30. Display 30 includes a lower side 32 and an upper side 33, similar to sides 12 and 13 of Display 10 above. In this embodiment, tack 35 includes a chip 39 fixedly attached to side 32 by means of a thin layer of frit 49. Chip 39 is preferably attached to side 32 with a high temperature resistant adhesive such as divitrifying frit, a Titanium-Tungsten ceramic adhesion layer, chrome or the like.

A metallic film 41 of predetermined thickness is deposited by screen printing, patterning, evaporation, etc. onto an exposed major face or upper surface of chip 39. In this specific embodiment, metallic film 41 includes an adhesion layer, generally formed of TiW, Cr, or the like, and a layer of gold or other contact metal. As will be understood by those skilled in the art, the adhesion layer is used because the gold normally does not adhere well to ceramic and the like. Film 41 is generally deposited onto chip 39 before chip 39 is secured to side 32.

A thick layer 42 of contact metal, such as silver or the like, is deposited onto side 33, and may desirably but not essentially comprise approximately 500 angstroms of the metal. In this specific embodiment, layer 42 includes silver paste, which may be applied by any convenient method. Layer 42 is formed relatively thick to automatically allow for any "wedging" or non-parallel orientation between the surface of side 33 and the surface of film 41 on chip 39. Such wedging can occur during the formation of thick layer 42 of contact metal or during the fixing of chip 39 to the surface of side 32. Generally, the contact metal of metallic film 41 and the metal of layer 42 are chosen so that they will quickly and easily diffuse together to fix sides 32 and 33 firmly in position.

With sides 32 and 33 formed as described, the preferred assembly process is generally as follows. Sides 32 and 33 are placed in a substantial vacuum in a vacuum chamber and aligned in a parallel spaced apart condition, with metallic film 41 substantially opposing layer 42. An edge of vitreous frit or the like, is positioned between sides 32 and 33 in the form of a substantially continuous structure. The vacuum chamber is then heated in what is commonly referred to as a "heat up" period. During the heat up period, the vacuum chamber is heated to a temperature that is sufficient to cause the frit, the contact metal (e.g. gold) in metallic film 41, and layer 42 are heated to assist in diffusion bonding. To form the envelope, sides 32 and 33 are moved together to bring metallic film 41 into contact with layer 42. The formation of the edge and the contact between metallic film 41 and layer 42 occurs substantially simultaneously at a desired seal height. The contact between metallic film 41 and layer 42 forms a metallic alloy, in this instance a silver-gold alloy, that forms the bond. The formation of the bond and, thus, tack 35, creates an aggressive and substantially immediate and substantially rigid engagement between sides 32 and 33. To complete the sealing process, the envelope is transferred to a curing oven for curing the frit of the edge. Until the edge material has sufficiently cured and solidified, the edge remains in a low viscous state. However, tack 35 prevents any relative movement of sides 32 and 33 and any coincident misalignment that could otherwise fail the envelope in response to handling while the edge remains in the low viscous state. As a result, the envelope may be transferred to a curing oven within only a few minutes of being sealed without the risk of component misalignment.

Figure 3:
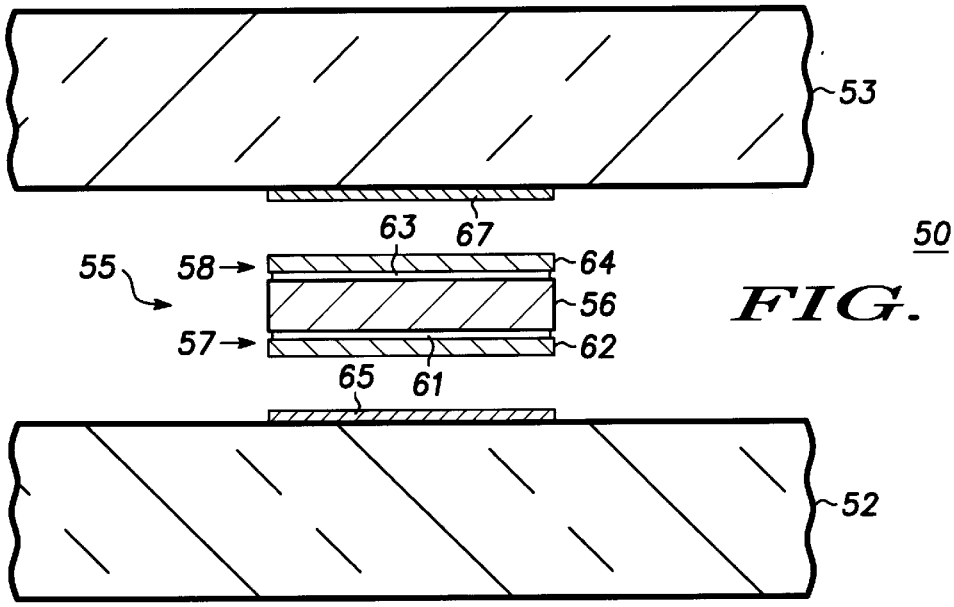
FIG. 3 is a sectional view of a portion of the envelope of FIG. 1 showing another embodiment of the tack as it would appear prior to being sealed.

Turning now to FIG. 3, another embodiment of a tack 55 is illustrated prior to the sealing of a display 50. Display 50 includes a lower side 52, which in this specific embodiment is a semiconductor substrate, and an upper side 53, which is a glass faceplate for display 50. In this embodiment, tack 55 includes a chip 56 having a thin metallic film 57 deposited on the lower major surface and a thin metallic film 58 deposited on the upper major surface. Films 57 and 58 are deposited by some convenient means, such as evaporation or sputtering. In this specific embodiment, lower film 57 includes an adhesive layer 61, selected to bond well to ceramic and the like, deposited directly on the lower surface of chip 56 and including a metal such as TiW or Cr. The surface of adhesive layer 61 is polished to ensure that it is very flat and smooth so that it will bond properly to the flat surface of lower side 52. A layer of gold or other contact metal is then deposited on the surface of layer 61. Film 58 includes an adhesive layer 63, selected to bond well to ceramic and the like, deposited directly on the upper surface of chip 56 and including a metal such as TiW or Cr. The surface of adhesive layer 63 is flattened by lapping or the like to ensure that it is sufficiently flat to bond properly to the surface of upper side 52. A layer of gold or other contact metal is then deposited on the surface of layer 63.

A thin film 65 is deposited on the upper surface of side 52, generally during a normal semiconductor process, and may be, for example, a thin film of molybdenum or other material compatible with the semiconductor process deposited by CVD. Thin film 65 will generally be a few angstroms thick and preferably approximately 1 angstrom thick.

A thin film 67 of convenient metal, such as aluminum, is deposited on the lower surface of side 53 in register with thin film 65. Aluminum is used in this example because side 53 is the faceplate for display 50 and has an aluminum layer deposited thereon to serve as a light reflector and electrical return. Thus, thin films 65 and 67 are deposited as a normal portion of the manufacturing process and do not entail extra steps or procedures.

As described above, the contact metals of metallic films 57 and 58 and the metals of films 65 and 67 are chosen so that they will quickly and easily diffuse together to fix sides 52 and 53 firmly in position. With sides 52 and 53 and tack 55 formed as described, the preferred assembly process is generally as follows. Sides 52 and 53 are placed in a substantial vacuum in a vacuum chamber and aligned in a parallel spaced apart condition, with film 65 substantially opposing film 67. Tack 55 is placed in alignment with films 65 and 67, as illustrated in FIG. 3. The vacuum chamber is then heated to melt the sealing frit and to outgas all components contained within display 50. After a suitable heating period, sides 52 and 53 are brought into contact with tack (or tacks) 55 and the sealing frit around the edges. Metallic films 57 and 58 bond with thin films 65 and 67, respectively, very rapidly and hold sides 52 and 53 in the desired relative position. As a result, display 50 may be transferred to a curing oven within only a few minutes of being sealed without the risk of component misalignment.

Thus, a method of fabricating a high vacuum field emission display with flat form factor is disclosed, which allows sealed FED packages to be transferred to a curing oven prior to the solidification of vitreous frit without causing component misalignment, greatly increases throughput and facilitates high volume manufacturing of FED packages. The method is relatively easy and inexpensive to perform and displays can be sequentially fabricated quickly with a very flat form factor.

While we have shown and described specific embodiments of the present invention, further modifications and improvements will occur to those skilled in the art. We desire it to be understood, therefore, that this invention is not limited to the particular forms shown and we intend in the appended claims to cover all modifications that do not depart from the spirit and scope of this invention.

What is claimed is:

1. A method of fabricating a high vacuum device, comprising:

depositing a metallic film onto a first major face of a tack;

affixing a second major face of the tack to a first major side of the high vacuum device with a high temperature resistant adhesive;

depositing a thick layer of contact metal onto a surface of a second major side of the high vacuum device;

depositing a vacuum sealing material on edges of one of the first and second major sides;

placing the first and second major sides in a vacuum chamber with the thick layer of contact metal opposing the metallic film on the tack;

creating a substantial vacuum;

heating the high vacuum device in the substantial vacuum sufficiently to bond the metallic film and the contact metal and to achieve a vacuum sealing by the vacuum sealing material; and removing the high vacuum device from the vacuum chamber while the vacuum sealing material is in a low viscosity state.

2. The method according to claim 1, wherein the step of depositing a metallic film comprises the steps of:

depositing an adhesion layer; and depositing a layer of second contact material.

3. The method according to claim 2, wherein the adhesion layer comprises one or more of titanium, tungsten, and chromium, and the second contact material is gold.

4. The method according to claim 1, wherein the metallic film comprises gold.

5. The method according to claim 1, wherein the high temperature resistant adhesive comprises one of devitrifying frit, a titanium-tungsten adhesion layer and chrome.

6. The method according to claim 1, wherein the thick layer of contact metal comprises silver and is approximately 500 Angstroms thick.

7. The method according to claim 1, wherein the sealing material is glass frit.

8. The method according to claim 1, further comprising curing the sealing material of the high vacuum device in a curing chamber at atmospheric pressure.

9. The method according to claim 1, wherein the tack comprises ceramic or similar non-metallic material.

10. The method according to claim 1, wherein the tack is approximately 4×4 mm square by 0.7 mm thick.

11. A method of fabricating a high vacuum device, comprising:

attaching a tack device having a metallic film on an exposed face to a first of two major sides of a high vacuum device using an attachment technique that maintains the attachment at bonding and curing temperatures;

placing the two major sides in a vacuum chamber with the metallic film on the tack aligned to a thick layer of contact metal on a second of the two major sides;

heating the high vacuum device in a substantial vacuum to bond together the metallic film and the contact metal and to achieve a vacuum seal by the edge vacuum sealant of the high vacuum device; and removing the high vacuum device from the vacuum chamber while the edge vacuum sealant is in a low viscosity state.

12. The method according to claim 11, further comprising:

curing the edge vacuum sealant at atmospheric pressure in a curing oven.

13. A method of fabricating a high vacuum device, comprising:

placing two major sides of the high vacuum device in a vacuum chamber;

heating the high vacuum device in a substantial vacuum to bond the two major sides together with at least one tack located between the two major sides that bonds to both of the major sides, wherein bonding to at least one of the major sides is a metallic bond formed by the heating, and wherein the bonded tack prevents subsequent misalignment of the two major sides, and wherein the heating sufficiently initiates a sealing process of an edge vacuum sealant of the high vacuum device to maintain a vacuum seal at atmospheric pressure; and removing the high vacuum device from the vacuum chamber while the edge vacuum sealant is in a low viscosity state.

14. The method according to claim 13, further comprising:

curing the edge vacuum sealant at atmospheric pressure in a curing oven.

* * * * *